US009745941B2

(12) United States Patent
Atluru et al.

(10) Patent No.: US 9,745,941 B2
(45) Date of Patent: Aug. 29, 2017

(54) TUNABLE STARTER RESISTOR

(71) Applicant: Ford Global Technologies, LLC, Dearborn, MI (US)

(72) Inventors: Ravi Atluru, Novi, MI (US); Xiangying Liu, Ann Arbor, MI (US); Christina Le, Canton, MI (US); Kenneth W. Hampton, Novi, MI (US); Charles De Biasi, Plymouth Township, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 192 days.

(21) Appl. No.: 14/264,625

(22) Filed: Apr. 29, 2014

(65) Prior Publication Data

US 2015/0308395 A1 Oct. 29, 2015

(51) Int. Cl.

| | |
|---|---|
| ***F02N 11/08*** | (2006.01) |
| ***H01C 10/10*** | (2006.01) |
| ***H01C 7/06*** | (2006.01) |
| ***H01C 17/30*** | (2006.01) |
| ***F02N 11/10*** | (2006.01) |
| *H01C 17/065* | (2006.01) |
| *F02N 11/00* | (2006.01) |
| *F02N 15/06* | (2006.01) |

(52) U.S. Cl.

CPC ..... *F02N 11/08* (2013.01); *F02N 11/10* (2013.01); *H01C 7/06* (2013.01); *H01C 10/10* (2013.01); *H01C 17/30* (2013.01); *F02N 11/00* (2013.01); *F02N 11/087* (2013.01); *F02N 15/067* (2013.01); *F02N 2011/0881* (2013.01); *H01C 17/0652* (2013.01); *H01C 17/06526* (2013.01)

(58) Field of Classification Search

CPC ..... F02N 11/08; F02N 11/0862; F02N 2011/0881; F02N 11/10; H01C 10/10; H01C 7/06; H01C 17/30

USPC ..... 290/38 R

See application file for complete search history.

(56) References Cited

U.S. PATENT DOCUMENTS

| | | | | |
|---|---|---|---|---|
| 2,730,597 | A | 1/1956 | Podolsky et al. | |
| 2,883,502 | A | 4/1959 | Rudner | |
| 3,205,467 | A | 9/1965 | Ganci | |
| 3,411,123 | A * | 11/1968 | Kydd | H05B 3/06 219/388 |
| 4,055,615 | A * | 10/1977 | Ikeda | H01C 17/30 264/105 |
| 5,656,981 | A * | 8/1997 | Niimi | F02N 11/087 335/126 |
| 5,731,638 | A * | 3/1998 | Niimi | F02N 11/0851 123/179.1 |
| 6,759,756 | B2 | 7/2004 | Shiga et al. | |
| 7,804,180 | B2 | 9/2010 | Labbe et al. | |
| 8,436,426 | B2 * | 5/2013 | Le Neel | H01L 21/76834 257/359 |
| 2003/0100653 | A1 * | 5/2003 | Chacko | H01C 7/005 524/440 |

(Continued)

*Primary Examiner* — Viet Nguyen

(74) *Attorney, Agent, or Firm* — David Kelley; Brooks Kushman, P.C.

(57) ABSTRACT

A passive two-terminal circuit element may include a resistor including a carbon-metal composite resistive element. The resistive element is configured to maintain a resistivity that fluctuates less than one tenth of an ohm per ten degree temperature change up to 400 degrees Celsius.

12 Claims, 7 Drawing Sheets

(56) References Cited

U.S. PATENT DOCUMENTS

| | | | | |
|---|---|---|---|---|
| 2003/0189472 | A1* | 10/2003 | Shiga | F02N 11/087 335/126 |
| 2003/0193382 | A1* | 10/2003 | Shiga | F02N 11/087 335/126 |
| 2004/0017086 | A1* | 1/2004 | Shiga | F02N 11/0851 290/38 R |
| 2004/0262712 | A1* | 12/2004 | Doi | H01C 1/14 257/536 |
| 2012/0200093 | A1* | 8/2012 | Venkatasubramaniam | F02N 11/0859 290/38 R |
| 2012/0293300 | A1* | 11/2012 | Chung | H01C 7/105 338/331 |
| 2013/0157864 | A1 | 6/2013 | Talvacchio et al. | |

* cited by examiner

TUNABLE STARTER RESISTOR

TECHNICAL FIELD

Disclosed herein is a tunable starter resistor.

BACKGROUND

Vehicles are often started via a starter motor circuit. During a vehicle start, a starter motor may draw a large amount of current from a vehicle battery to crank the engine. Due to low resistances for the starter motor and electrical wiring, the inrush current may be high, creating a large draw on the battery. This draw may cause significant drop in battery voltage. Due to this inrush condition, other vehicle systems that also draw from the battery may be left without enough voltage during the vehicle start.

SUMMARY

A passive two-terminal circuit element may include a resistor including a carbon-metal composite resistive element, the resistive element configured to maintain a resistivity that fluctuates less than one tenth of an ohm per ten degree temperature change up to 400 degrees Celsius.

A starter circuit for a vehicle may include a battery, a starter motor, a solenoid switch arranged between and fluidly connected to the battery and the starter motor, the switch configured to close in response to an ignition signal, and a resistor including a carbon-metal composite resistive element arranged between the battery and the starter motor and configured to act on a current drawn from the battery in response to the solenoid switch closing.

A starter circuit for a vehicle may include a battery, a starter motor, and a resistor including a carbon-metal composite resistive element arranged between the battery and the starter motor and configured to act on a current drawn from the battery in response to the solenoid switch closing.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Disclosed herein is a tunable resistor for a starter assembly of a vehicle. The resistor may be in-line with a vehicle battery or starter motor to prevent the current draw on a battery from exceeding a predefined threshold during the vehicle start. The composition of the resistor, as well as the orientation of the sintered particles making up the composition, may affect the resistive and thermal properties of the resistor. In one example, the resistor may be approximately 80% carbon and 20% copper which may allow for a stable resistivity up to 400 degrees Celsius. The resistor may also be stable down to −40 degrees Celsius.

While carbon and copper are used as exemplary materials for the resistor 255, other materials may be used such as other metals, including other alloys.

Figure 1:
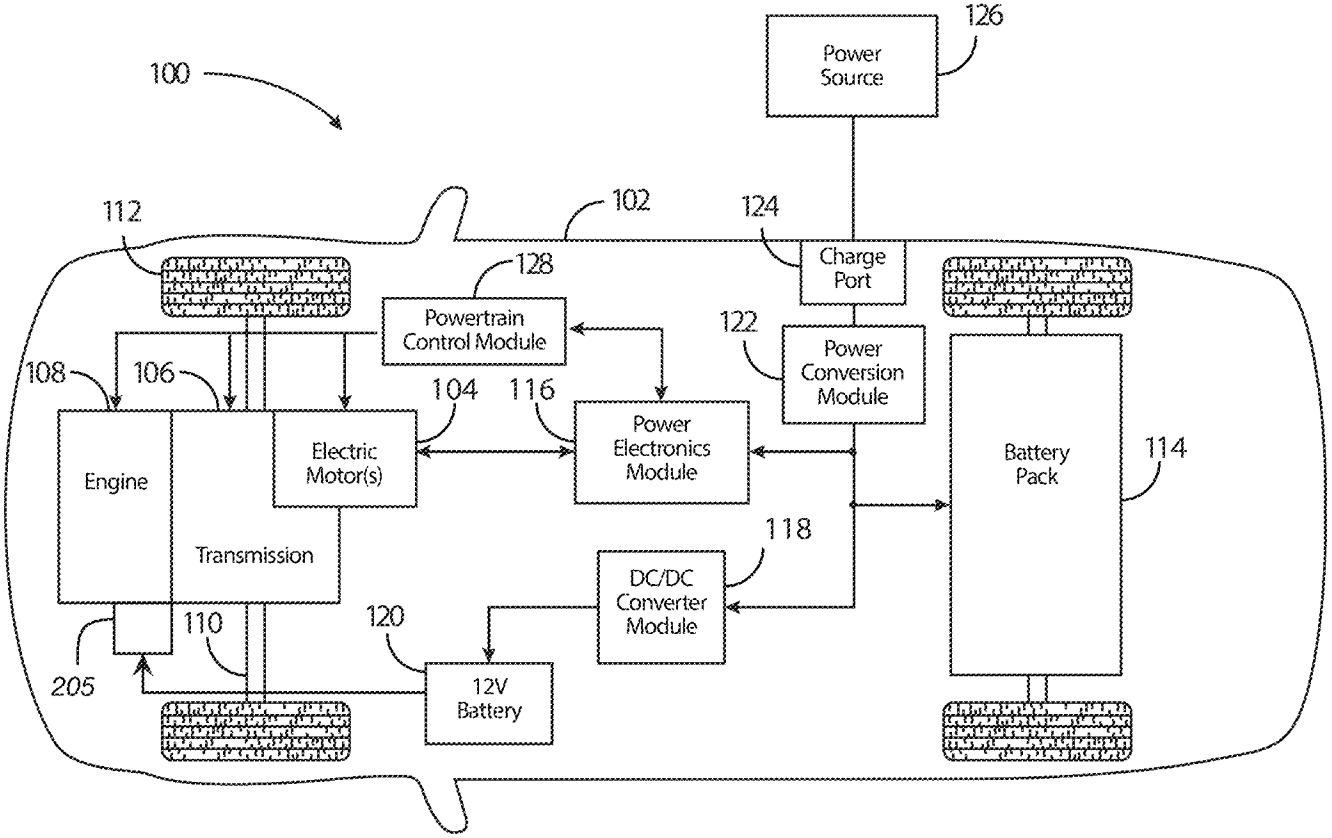
FIG. 1 illustrates an exemplary hybrid electric vehicle system.

FIG. 1 depicts an example of a vehicle system 100. A plug-in hybrid-electric vehicle (PHEV) 102 of the system 100 may comprise one or more electric motors 104 mechanically connected to a hybrid transmission 106. In addition, the hybrid transmission 106 is mechanically connected to an engine 108. The hybrid transmission 106 may also be mechanically connected to a drive shaft 110 that is mechanically connected to the wheels 112. The electric motors 104 can provide propulsion when the engine 108 is turned on. The electric motors 104 can provide deceleration capability when the engine 108 is turned off. The electric motors 104 may be configured as generators and can provide fuel economy benefits by recovering energy that would normally be lost as heat in the friction braking system. The electric motors 104 may also reduce pollutant emissions since the hybrid electric vehicle 102 may be operated in electric mode under certain conditions.

The battery pack 114 stores energy that can be used by the electric motors 104. A vehicle battery pack 114 typically provides a high voltage DC output. The battery pack 114 is electrically connected to a power electronics module 116. The power electronics module 116 is also electrically connected to the electric motors 104 and provides the ability to bi-directionally transfer energy between the battery pack 114 and the electric motors 104. For example, a typical battery pack 14 may provide a DC voltage while the electric motors 4 may require a three-phase AC current to function. The power electronics module 16 may convert the DC voltage to a three-phase AC current as required by the electric motors 104. In a regenerative mode, the power electronics module 116 will convert the three-phase AC current from the electric motors 104 acting as generators to the DC voltage required by the battery pack 114. The methods described herein are equally applicable to a pure electric vehicle or any other device using a battery pack.

In addition to providing energy for propulsion, the battery pack 114 may provide energy for other vehicle electrical systems. A typical system may include a DC/DC converter module 118 that converts the high voltage DC output of the battery pack 114 to a low voltage DC supply that is compatible with other vehicle loads. Other high voltage loads, such as compressors and electric heaters, may be connected directly to the high-voltage bus from the battery pack 114. In a typical vehicle, the low voltage systems are electrically connected to a 12V battery 120. An all-electric vehicle may have a similar architecture but without the engine 108.

The battery pack 114 may be recharged by an external power source 126. The external power source 126 may provide AC or DC power to the vehicle 102 by electrically connecting through a charge port 124. The charge port 124 may be any type of port configured to transfer power from the external power source 126 to the vehicle 102. The charge port 124 may be electrically connected to a power conversion module 122. The power conversion module may condition the power from the external power source 126 to provide the proper voltage and current levels to the battery pack 114. In some applications, the external power source 126 may be configured to provide the proper voltage and current levels to the battery pack 114 and the power conversion module 122 may not be necessary. The functions of the power conversion module 122 may reside in the external power source 126 in some applications. The vehicle engine, transmission, starter motor, electric motors and power electronics may be controlled by a powertrain control module (PCM) 128.

In addition to illustrating a plug-in hybrid vehicle, FIG. 1 may also illustrate a battery electric vehicle (BEV), a traditional hybrid electric vehicle (HEV) and a power-split hybrid electric vehicle (PHEV). The various components discussed may have one or more associated controllers to control and monitor the operation of the components. The controllers may communicate via a serial bus (e.g., Controller Area Network (CAN)) or via discrete conductors.

Figure 2:
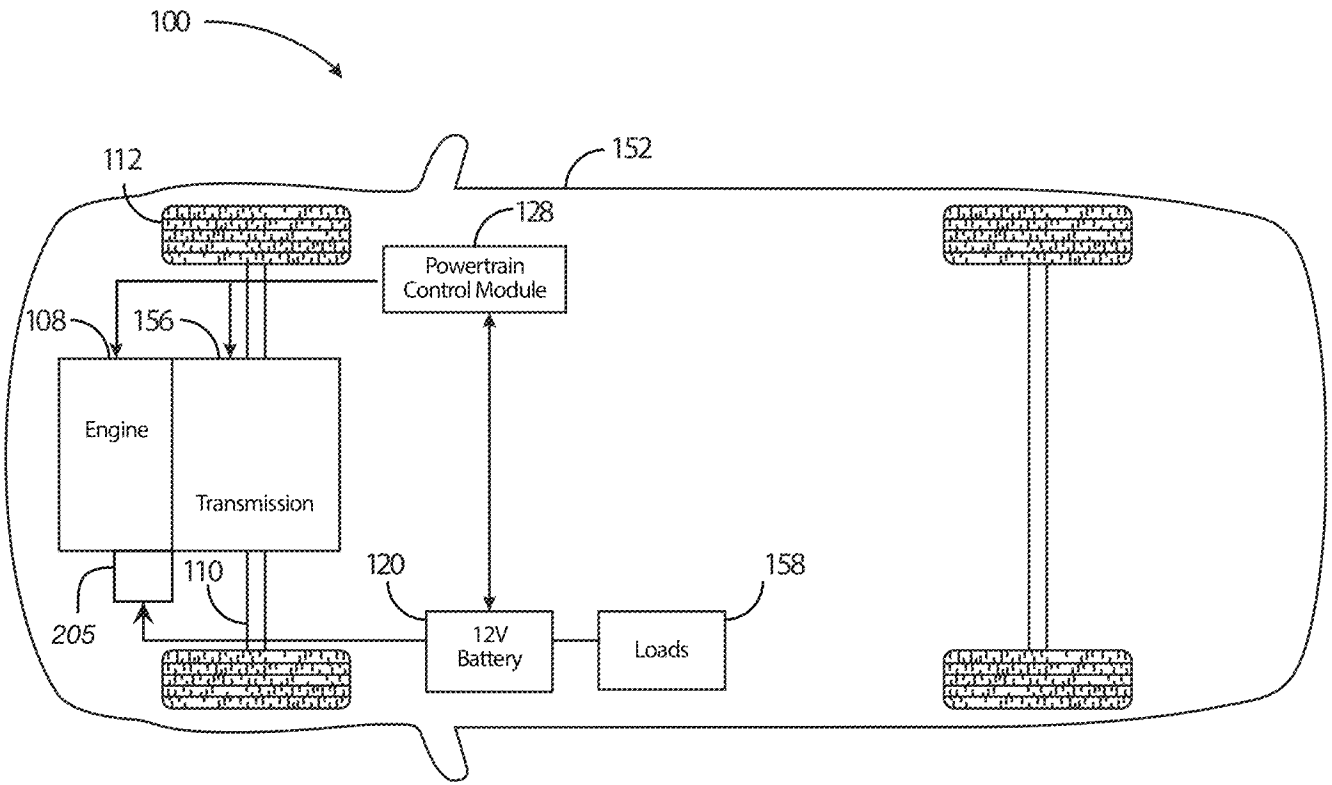
FIG. 2 illustrates an exemplary conventional vehicle system.

FIG. 2 depicts an example of a conventional vehicle 152. The vehicle may be a conventional gasoline/diesel or natural gas vehicle. The conventional vehicle 152 may be similar to the PHEV vehicle 102 of FIG. 1 in that it may include an engine 108, a drive shaft 110 connected to the wheels 112, a 12V battery 120, starter motor 205 and a powertrain control module 128. The transmission may be a conventional transmission 156. Additional loads 158 such as other vehicle systems requiring power may draw from the 12V battery 120.

Figure 3:
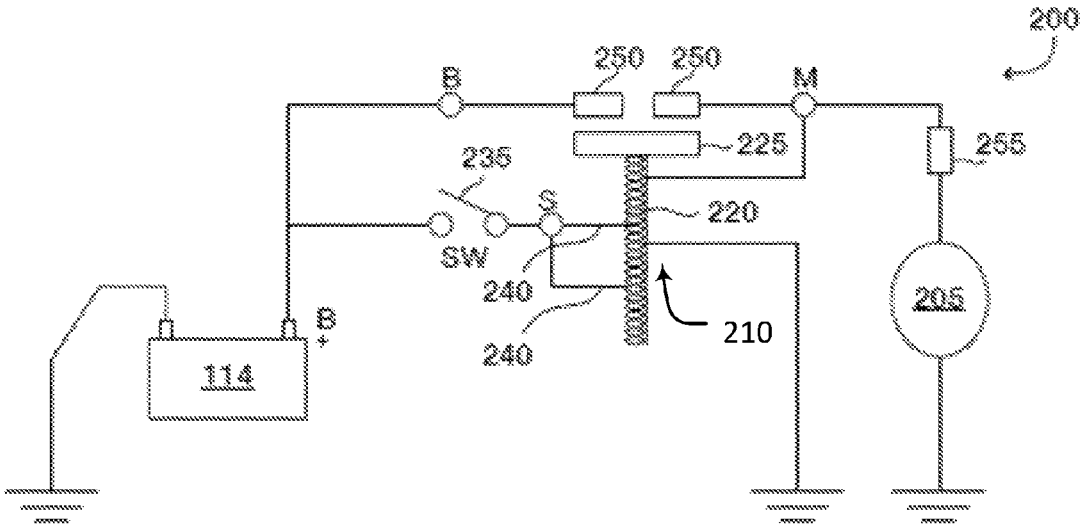
FIG. 3 illustrates an exemplary starter assembly of the vehicle systems.

FIG. 3 is an exemplary starter assembly 200. The starter assembly 200 may facilitate the start of vehicle upon receiving a start signal such as a small current from an ignition switch. The ignition switch may include a traditional key ignition. The ignition switch may also include a push-button switch or a remote switch (e.g., a remote starter system). During a vehicle start, the motor may draw a large current (also known as an inrush current) from the battery for a few milliseconds. During this short increment, the high current draw may result in a voltage skip. Because the vehicle battery supplies power to other vehicle systems, such as the radio, navigation systems, etc., power to these systems may be interrupted during the vehicle start in response to the voltage skip.

The starter assembly 200 may include a motor 205, such as a starter motor, and a solenoid assembly 210. The motor 205 may include a starter ring gear (not shown) configured to transfer torque from the starter motor 205 to the engine 108 in order to crank the engine 108 of the vehicle 105. The solenoid assembly may include a coil 220 and a solenoid switch 225. A starter switch 235 may be arranged between two leads 240 of the solenoid assembly 210 and the battery pack 114. In response to receiving the small current of the start signal, the starter switch 235 may close. Upon the closing of the starter switch 235, current from the battery 114 may flow to the leads 240 of the solenoid assembly 210. The current may be transmitted through the coil 220, which in turn may cause the solenoid switch 225 to move towards and come into contact with the two terminals 250, thus closing the connection between the battery 114 and the motor 205.

The solenoid assembly 210 thus closes the circuit between the battery 114 and the motor 205 allowing current to be drawn from the battery 114 by the motor 205. The motor 205 may use that current to crank the starter ring gear, which may then crank the engine to start. However, the current (i.e., inrush current) drawn from the battery 114 by the motor 205 to start the vehicle may be large. As explained, the large current draw may reduce the voltage of the battery 114 significantly and may affect the voltage supplied to other vehicle systems.

In order to prevent interruptions to the other vehicle systems, the solenoid assembly 210 may control the inrush current via a resistor 255. The resistor 255 may prevent the current drawn from the battery 114 from exceeding a predefined threshold current. The threshold current may be a current (e.g., 850A) that is large enough to crank the motor 205, but not too large so as to affect the power supplied to the other vehicle systems. The resistor 255 may be a smart tunable resistor configured to limit the inrush current. The resistor 255 may be arranged between the terminal 250 and the motor 205.

Figure 4:
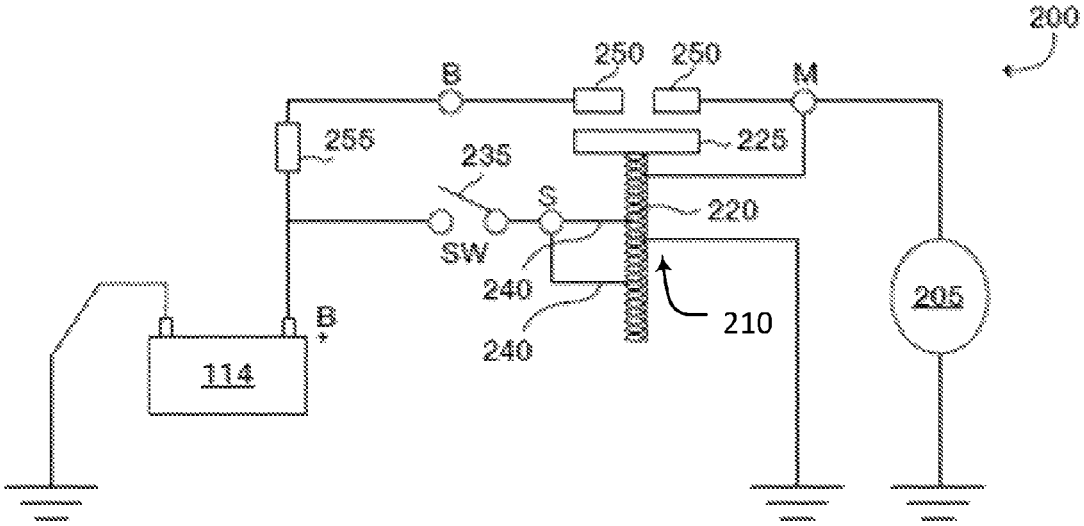
FIG. 4 illustrates another exemplary starter assembly of the vehicle systems.

Additionally, the resistor 255 may be arranged between the battery 114 and the terminal 250, as shown in FIG. 4. The resistor 255 may be in-line with the motor 105 in order to limit the amount of current drawn from the battery 114 by the motor 205. For example, the resistor 255 may act to maintain a battery voltage of approximately 7 volts, so as to not reduce the crank speed of the motor 205. In one example, the resistor may have adjustable characteristics, such as its size, composition, etc., so as to be tunable for various circuits. That is, depending on a vehicle's design, the resistor may be designed to achieve the appropriate current limits. In one example, the resistor 255 may be approximately 0.5 inches in length, 0.25 inches in diameter, and pack approximately a meter of 6 gauge copper wire. By keeping the resistor small, the resistor 255 may be packaged into existing starter circuit designs internally as well as externally.

Figure 5:
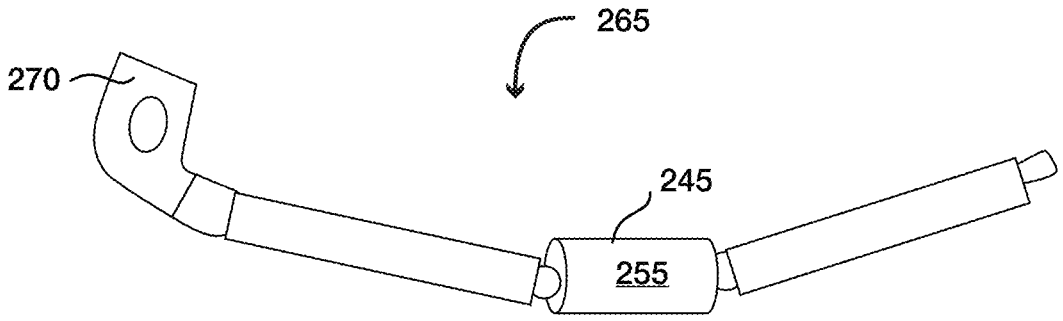
FIG. 5 illustrates an exemplary brush holder assembly of the starter assembly.

FIG. 5 is an exemplary brush holder assembly 265 including the resistor 255. The assembly 265 may include a brush lead 270 and may permit the resistor 255 to be added to an existing starter circuit.

The amount of desired resistivity of the resistor 255 may depend on the type of starter circuit 200. Certain materials at varying temperatures may affect the resistivity of an item differently. For example, the resistance of a carbon resistor may decrease as temperature increases, but the resistance of a copper resistor may increase under the same conditions (See FIG. 9.). It may be advantageous for the resistor 255 to be capable of withstanding high temperatures without failure or degradation. This may be the case, especially in situations when the starter circuit 200 is located near the vehicle engine or other components that have high operating temperatures.

Figure 9:
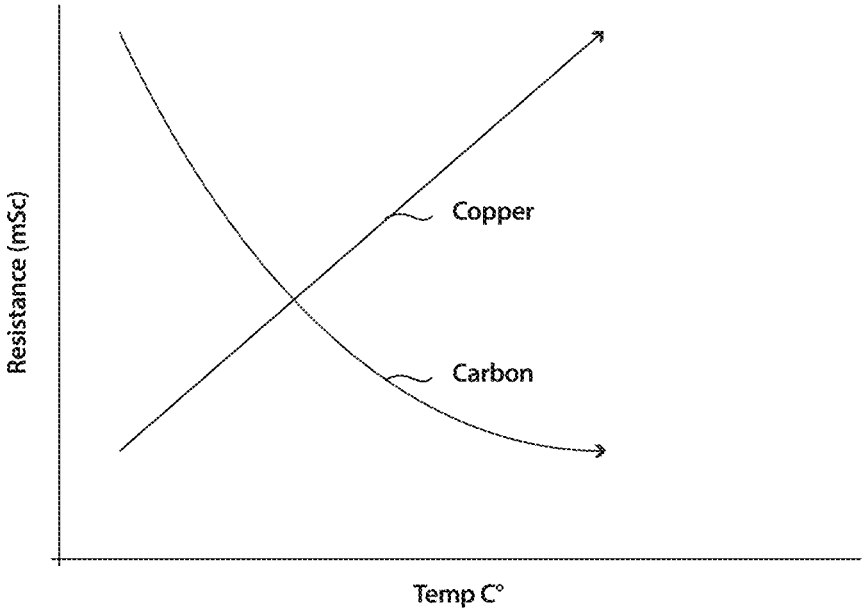
FIG. 9 illustrates an exemplary chart showing the relationship of resistance and temperature for certain materials.

The resistor 255 may have a resistive element 260 (shown in FIG. 6) being made of part carbon and part alloy. Depending on the desired resistivity, the percentage of each material may varied. In one example, the resistor 255 may have a desired resistance of approximately 1.3-1.5 milliohms and be made of 80% carbon and 20% copper. Such a composition may permit the resistor 255 to have a stable resistance for temperatures up to 400 degrees Celsius. Copper may have an approximate resistivity of $1.68\times10^{-8}$ ohms while carbon may have an approximate resistivity of $3\text{-}60\times10^{-6}$ ohms. Because copper has a lower resistance than carbon, increasing the copper percentage may decrease the resistive value of the resistor 255. However, the resistor 255 may still have a high temperature tolerance. As shown in FIG. 9, and discussed below, the resistivity of carbon may decrease as temperature increases. Additionally, the resistivity of copper may increase as temperature increases. By composing a resister having both materials, the resistivity may remain stable at extreme temperatures. That is, the resistance value may not fluctuate more than one hundredth of an ohm per ten degree temperature change. In some instances, the resistance may not fluctuate more than one tenth of an ohm over a ten degree temperature change. Moreover, the desired resistivity may be achieved by combining the appropriate amounts of carbon and copper. For example, a higher desired resistivity may require a higher amount of carbon, while a lower desired resistivity may be accommodated with a higher amount of copper.

The resistive materials may be bonded together via a sintering process where dust-like particles of each material are pressed together and heated. The size and/or volume of the particles, as well as the orientation of the particles, may also affect the resistivity and thermal properties of the resistor 255. For example, if the carbon particles are larger than the copper particles, the resistivity may be greater than when the carbon particles are larger and more numerous than the copper particles. Moreover, the orientation of the particles may affect the resistivity of the resistor 255. For example, the particles extending in the same direction as that of the current running through the resistor 255 may have a greater effect on the resistive properties than particles extending perpendicular, or opposite, the flow of current. In one example, the carbon particles may extend parallel with, or along, the direction of current flow while the copper particles may be bonded perpendicular to the carbon particles to provide a specific resistance value.

By modifying the composition of the resistor 255, as well as the orientation of the particles of the specific composition, the resistive properties may be altered. The resistor 255 may thus be tunable to fit the desired specifications of the starter circuit.

Figure 6:
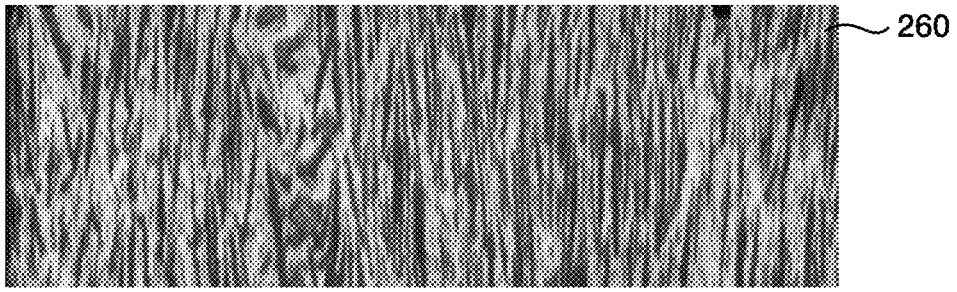
FIG. 6 illustrates an exemplary cross-sectional image of the resistor.

FIG. 6 illustrates an exemplary cross-sectional image of the resistive element 260 of the resistor 255. The image shows at least two particles sintered together. In one example, the dark portion of the image may represent carbon particles while the light portion may represent copper particles. The size of the carbon and copper particles and the their relative strength in the composition with orientation may alter the resistance The resistor 255 may also include an insulation cover 245 (depicted in FIG. 5) to also aid in protecting the resistive value from being affected by external temperatures. The cover 245 may permit the resistor 255 to withstand high temperatures without failure or degradation. Additionally, the cover 245 may protect from shorting and corrosion. The resistor, based on its design and insulated cover 245, may also be durable and capable of having a long life cycle. For example, the resistor 255 may be capable of surviving at least 200,000 cranking cycles.

Figure 7:
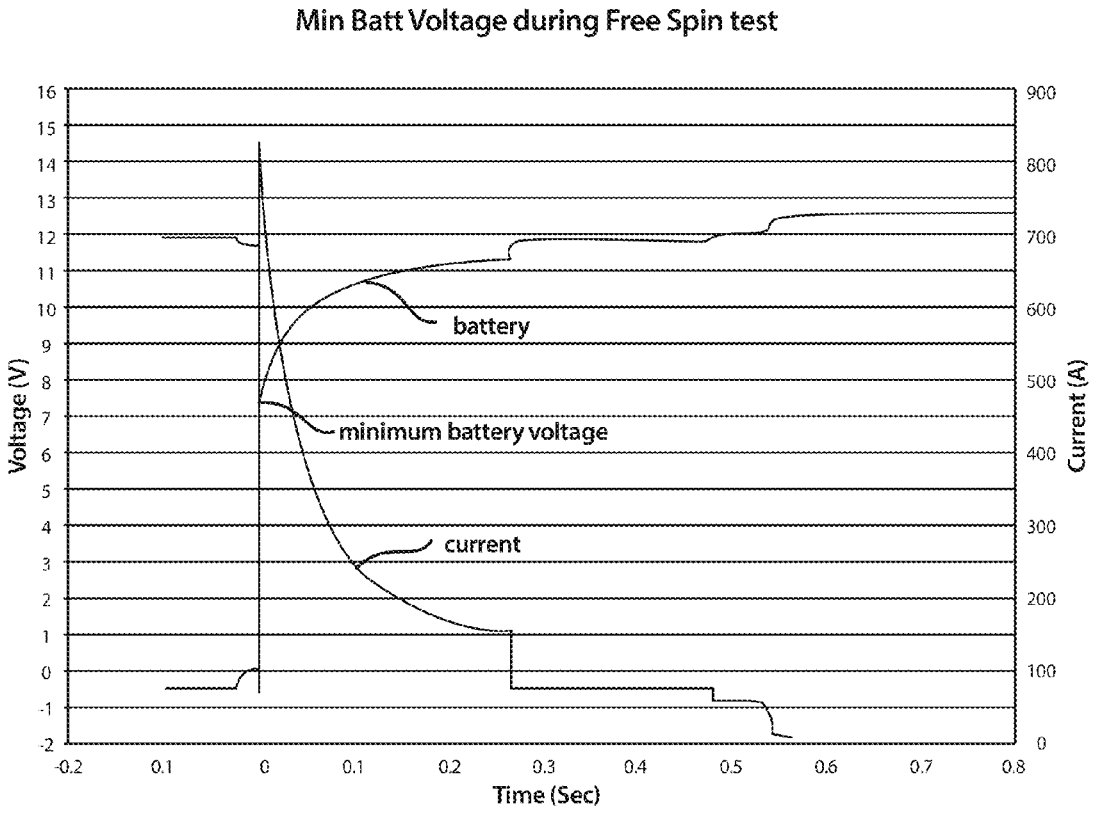
FIG. 7 illustrates an exemplary chart for a voltage quality test for the starter circuit.

FIG. 7 is an exemplary chart for a voltage quality test for starter circuit 200 having the resistor 255 and an aged battery. The minimum battery voltage with an internal resistance of 5.5 mOhm is shown. Shown in FIG. 7 are the respective voltages for the battery 114 and the current of the battery 114. The exemplary test results shown in FIG. 7 indicate that the minimum battery voltage with an end of life battery for the starter circuit is 7.06V. If the resistor 255 was not present in the starter circuit, the minimum battery voltage would have been 0.6V lower.

Figure 8:
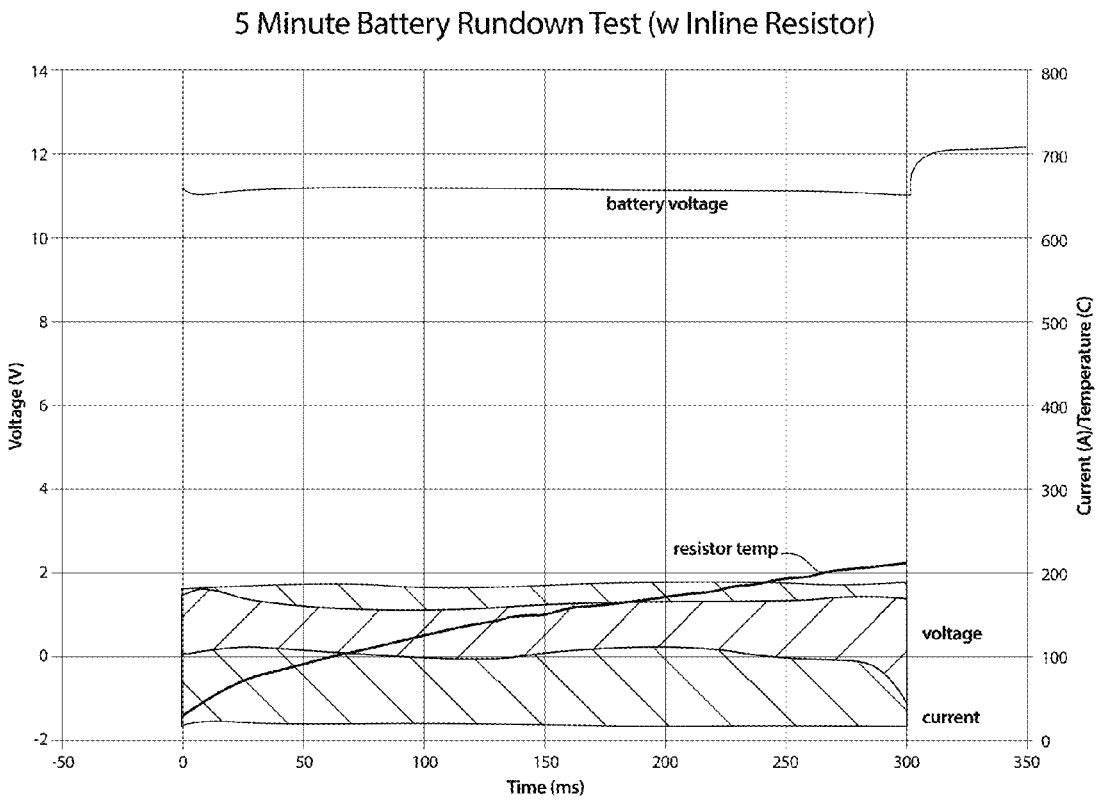
FIG. 8 illustrates an exemplary chart for a five minute continuous test for the starter circuit.

FIG. 8 is an exemplary chart for a five minute rundown test for the starter circuit 200. The chart shows the battery voltage, the current, and the temperature of the resistor 255. As shown in the chart, the temperature of the resistor 255 may gradually increase. However, the resistor 255, the starter motor 205 and the battery 114 have no failure during five minute battery rundown test. Additionally, the insulated cover also survived this high temperature test (e.g., no smoke or degradation of material).

Figure 10:
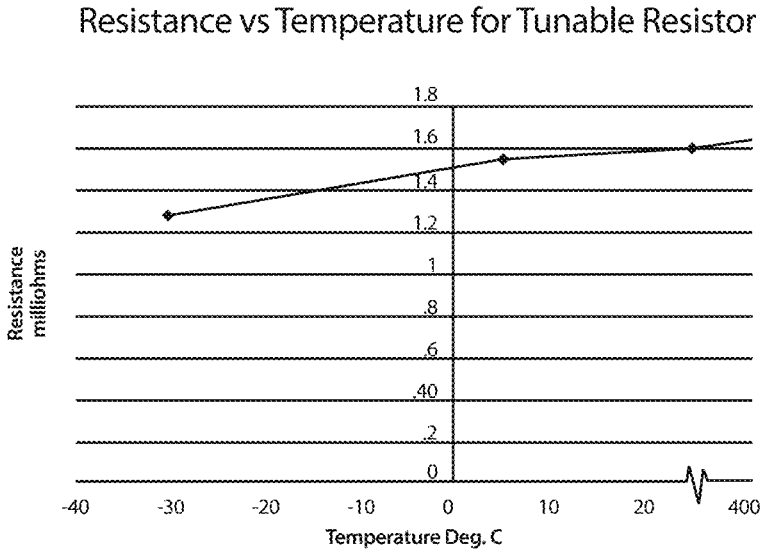
FIG. 10 illustrates an exemplary chart showing the resistance over temperature for an exemplary resistor.

FIG. 9 is an exemplary chart showing the relationship of resistance and temperature for each carbon and copper. As shown in the figure, as the temperature increases, the resistivity of copper increases. However, unlike copper, the resistivity of carbon decreases as the temperature increases. FIG. 10 is a chart showing the resistance over temperature for the exemplary resistor 255 comprising 80% carbon and 20% copper.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their broadest reasonable constructions and their ordinary meanings as understood by those knowledgeable in the technologies described herein unless an explicit indication to the contrary in made herein.

What is claimed is:

1. A starter circuit for a vehicle comprising:

a battery;

a starter motor;

a solenoid switch electrically connected between the battery and the starter motor, the switch configured to close in response to an ignition signal; and a resistor including a carbon-metal composite resistive element arranged between the battery and the starter motor and configured to act on a current drawn from the battery in response to the solenoid switch closing, the resistor comprising carbon particles and copper particles, the carbon particles extending along an axis parallel with the current through the resistor and the copper particles extending perpendicular to the carbon particles.

2. The circuit of claim 1, wherein the resistor includes wire.

3. The circuit of claim 1, wherein the resistor has a length of approximately 0.5 inches and a diameter of approximately 0.25 inches.

4. The circuit of claim 1, wherein the resistor is approximately 75-85% carbon.

5. The circuit of claim 1, wherein the resistor is arranged between the solenoid switch and the motor.

6. The circuit of claim 1, wherein the resistor is arranged between the battery and the solenoid switch.

7. The circuit of claim 1, wherein the resistor is internal to the starter motor.

8. A starter circuit for a vehicle comprising:

a battery;

a starter motor; and a resistor including a carbon-metal composite resistive element arranged between the battery and the starter motor and configured to act on a current drawn from the battery in response to a solenoid switch closing, wherein the resistor comprises carbon particles extending perpendicular to copper particles, the carbon particles extending along an axis parallel with a current flow through the resistor.

9. The circuit of claim 8, wherein the resistor is configured to maintain a resistivity for up to 400 degrees Celsius.

10. The circuit of claim 9, wherein the resistivity of the resistor fluctuates no more than one hundredth of an ohm over a ten degree temperature change.

11. The circuit of claim 8, wherein the resistor is approximately 75-85% carbon.

12. The circuit of claim 8, wherein the carbon and copper particles are sintered together.

* * * * *